United States Patent [19]

Motokawa

[11] 4,119,836

[45] Oct. 10, 1978

[54] HEAT-CONTROLLED DOCTOR KNIFE

[75] Inventor: Yutaka Motokawa, Kakogawa, Japan

[73] Assignee: Kakogawa Plastics Kabushiki Kaisha, Kokagawa, Japan

[21] Appl. No.: 817,598

[22] Filed: Jul. 21, 1977

Related U.S. Application Data

[63] Continuation-in-part of Ser. No. 635,320, Nov. 26, 1975, abandoned.

[51] Int. Cl.[2] ..... H05B 3/34

[52] U.S. Cl. ..... 219/528; 30/140; 118/261; 219/345; 219/549

[58] Field of Search ..... 219/345, 421, 517, 528, 219/546, 549; 118/261; 338/212, 255, 314; 30/140

[56] References Cited

U.S. PATENT DOCUMENTS

| | | | |
|---|---|---|---|
| 881,381 | 5/1908 | Andrews et al. | 219/517 X |
| 2,213,117 | 8/1940 | Blackmore | 118/261 X |
| 2,328,990 | 9/1943 | Meyer | 118/261 X |
| 2,361,950 | 11/1944 | Leech | 118/261 X |
| 2,375,812 | 5/1945 | Nordstrom et al. | 118/261 X |
| 3,022,412 | 2/1962 | Waters | 219/549 |
| 3,423,574 | 1/1969 | Shomphe et al. | 219/528 |
| 3,859,504 | 1/1975 | Motokawa et al. | 219/345 |

*Primary Examiner*—Volodymyr Y. Mayewsky
*Attorney, Agent, or Firm*—Lane, Aitken, Dunner & Ziems

[57] ABSTRACT

A flexible, heat-controlled doctor knife has a flat, flexible, heat-generating element affixed to one side of the knife blade. Blade flexing means which can adjust the angle of the working edge of the knife are provided on one side of the blade, adjacent to the working edge. The heat-generating element provides uniform heating of the knife and is a laminate having an electrically-conducting layer with alternating layers of a synthetic resin insulator and aluminum foil. An edge of the heat-generating element extends adjacent to the blade flexing means. Temperature control means regulate the heating of the blade.

3 Claims, 5 Drawing Figures

HEAT-CONTROLLED DOCTOR KNIFE

CROSS-REFERENCE TO RELATED APPLICATION

The present application is a continuation-in-part of application Ser. No. 635,320, filed Nov. 26, 1975 now abandoned, and entitled "A Heat-Controlled Doctor Knife".

FIELD OF THE INVENTION

This invention concerns a heat-controlled doctor knife with heating means mounted on one side of the doctor knife.

BACKGROUND OF THE INVENTION

Doctor knives are currently widely used as an expedient to regulate the amounts of liquid to be applied on sheet-like materials, such as woven and non-woven fabrics, paper, films and the like, to maintain a uniform thickness of the applied liquid layer. For example, when printing a sheet material with ink or coating a sheet material with a resin solution, a doctor knife is usually employed to control the amount of the printing ink or coating resin solution transferred to an applicator roll.

However, printing ink and resin coating solution are generally viscous materials, with their viscosity varying with the temperature. Accordingly, when applying printing ink or resin coating solution on the sheet material, a uniform application is difficult since the viscosity of the printing ink or resin coating solution varies with ambient temperatures. For instance, in the winter season, except for operations in air-conditioned rooms, the printing ink and resin solution tend to stick on the surface of the doctor knife and solidify upon cooling, gathering thereon additional ink or resin solution. The deposit of solidified ink or resin solution grows to a form similar to a "stalagmite", adversely affecting the uniform application of the ink or resin solution.

SUMMARY OF THE INVENTION

The present invention therefore has as its object the provision of a heat-controlled doctor knife which can ensure the uniform application of a liquid material on a sheet material without being influenced by the ambient temperature.

It has now been discovered that a coating of uniform thickness can be formed on a sheet material without being influenced by the ambient temperature by using a doctor knife which has a flat, flexible, heating element mounted on one side thereof to maintain the coating material in a thermally conditioned state.

The above and other objects, features and advantages of the present invention will become apparent from the following description, taken in conjunction with the accompanying drawings, which show by way of example a preferred embodiment of the present invention.

DETAILED DESCRIPTION OF THE INVENTION

Figure 1:
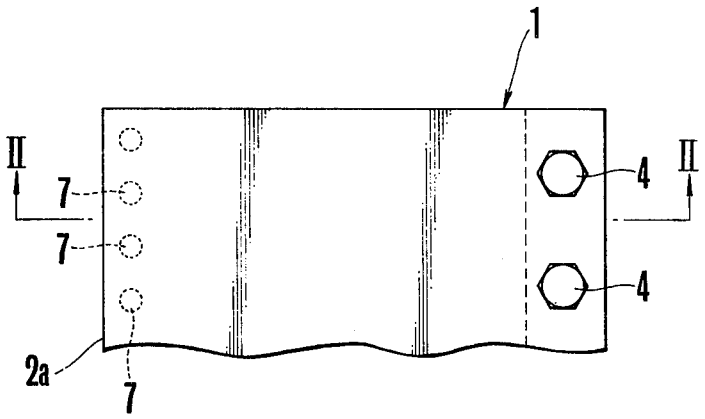
FIG. 1 is a plan view of the doctor knife used in the present invention.
Figure 2:
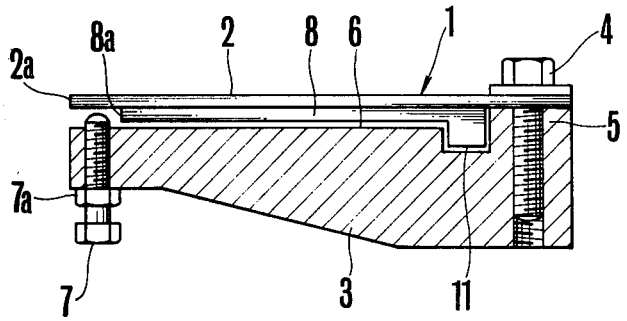
FIG. 2 is a cross-sectional view of the doctor knife shown in FIG. 1; as seen along line 2—2.

In FIGS. 1 and 2, reference numeral 1 generally indicates a flexible doctor knife having a blade 2 with an elongated working edge 2a. The blade 2 is secured along the other edge to a support member 3 by a plurality of fasteners 4, such as bolts, which are removeably engaged with an upstanding ridge 5 that extends along one edge of the support member. The ridge 5 provides a clearance 6 between the lower surface of the blade 2 and the upper surface of the support member 3. Positioned along the edge of the support member 3 opposite from the ridge 5 is a plurality of blade flexing or adjustment members 7, each with cooperating lock means 7a, such as bolts with cooperating nuts, which are vertically adjustable relative to the surface of the support members and engage the lower surface of the blade 2, adjacent to the working edge 2a, to vary the angle of the working edge. The blade flexing members 7 are disposed along the edge of the support member 3, spaced about 10 mm from the working edge 2a of the doctor knife 1. The knife blade 2 is flexible and may be made of, for example, steel or stainless steel, with a thickness of approximately 1–2 mm.

A flat, flexible, heat-generating element 8 is affixed on and in contact with one side of the blade 2, and is located within the clearance 6 between the blade and the support member 3. A temperature control means 10 is attached along one edge of the heat-generating element 8, which will be described more fully below, to provide heat regulation of the blade 2, and is received within a recess 11 provided in the support member 3.

Figure 3:
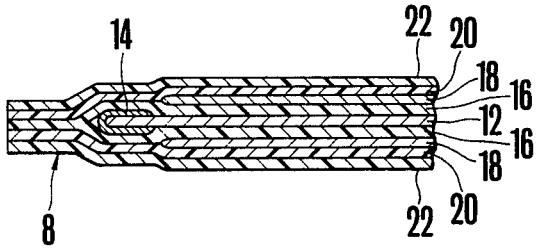
FIG. 3 is a cross-sectional view of a flat, flexible, heat-generating element for providing heat to the doctor knife of the present invention.

As noted, the heat-generating element 8 should be flat and flexible in order not to impair the flexibility of the doctor knife 1. Moreover, the heat-generating element 8 is preferably extremely small in thickness, and should be capable of uniform heat distribution. A suitable, flat, flexible, heat-generating element is disclosed, for example, in U.S. Pat. No. 3,859,504, which is a laminate having an electrically-conducting layer with alternating layers of a synthetic resin insulator and aluminum foil. An embodiment of this heat-generating element is shown in FIG. 3, in which a heating element 12 of a sheet of carbon fiber-containing paper is electrically connected to an electrode 14. Insulation layers 16 of a synthetic resin, such as polyethylene, are superposed on both sides of the heating element 12. Layers of aluminum foil 18 are laminated between the insulation layers 16 and second insulation layers 20 of a synthetic resin, which may also be of polyethylene. The outer surfaces of the heat-generating element 8 may be covered with sheets 22 of a synthetic resin, such as a polyester. The heating element 12 is adapted to be heated by passing electricity through the electrode 14. The insulation layers provide good electrical and moisture insulation while still permitting good heat transfer.

The heat-generating element 8 is affixed to the blade 2 such that an edge 8a extends parallel to the working edge 2a of the blade, and is disposed adjacent to the row of blade flexing members 7. Therefore, the side of the blade 2 to which the heat-generating element 8 is attached is not completely covered by the heat-generating element. More particularly, the surface of the blade 2 adjacent to the working edge 2*a*, which is contacted by the blade flexing members 7, is uncovered since a portion of the heat-generating element 8 in this region would be pressed by the head of the member, which may possibly damage the element, with the result that the doctor knife 1 is not uniformly heated.

The heat-generating element 8 may be secured to the blade 2 by any suitable means, such as the use of an adhesive agent or a duplex adhesive tape placed between the contacting surfaces of the element and the blade 2.

Figure 4:
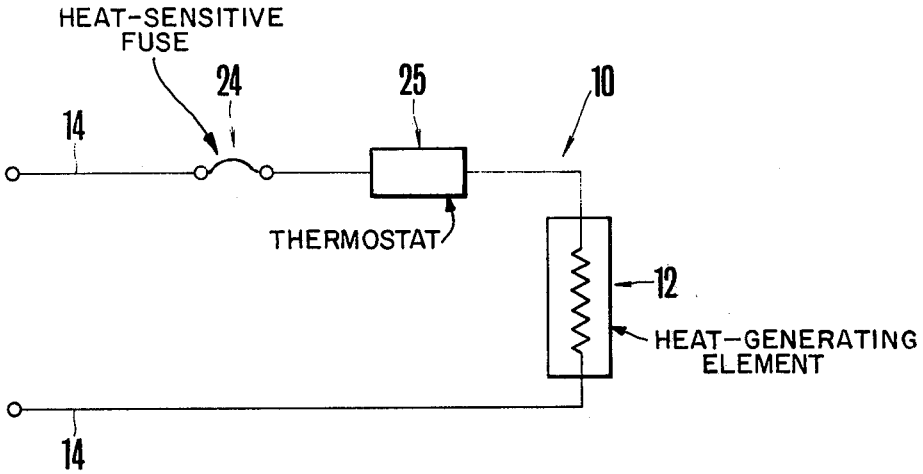
FIG. 4 is a schematic of a control means for regulating the temperature of the doctor knife.

FIG. 4 is a schematic of the temperature control means 10 for regulating the temperature of the doctor knife 1, which includes a heat-sensitive fuse 24 and a thermostat 25 connected in an electrical circuit which includes the electrode 14 connected to the heating element 12. The thermostat 25 permits selection of the desired temperature to which the blade 2 is heated, and the fuse 24 prevents overheating of the doctor knife 1. The ends of the conductor 14 are connected to an appropriate source of electrical energy (not shown).

Figure 5:
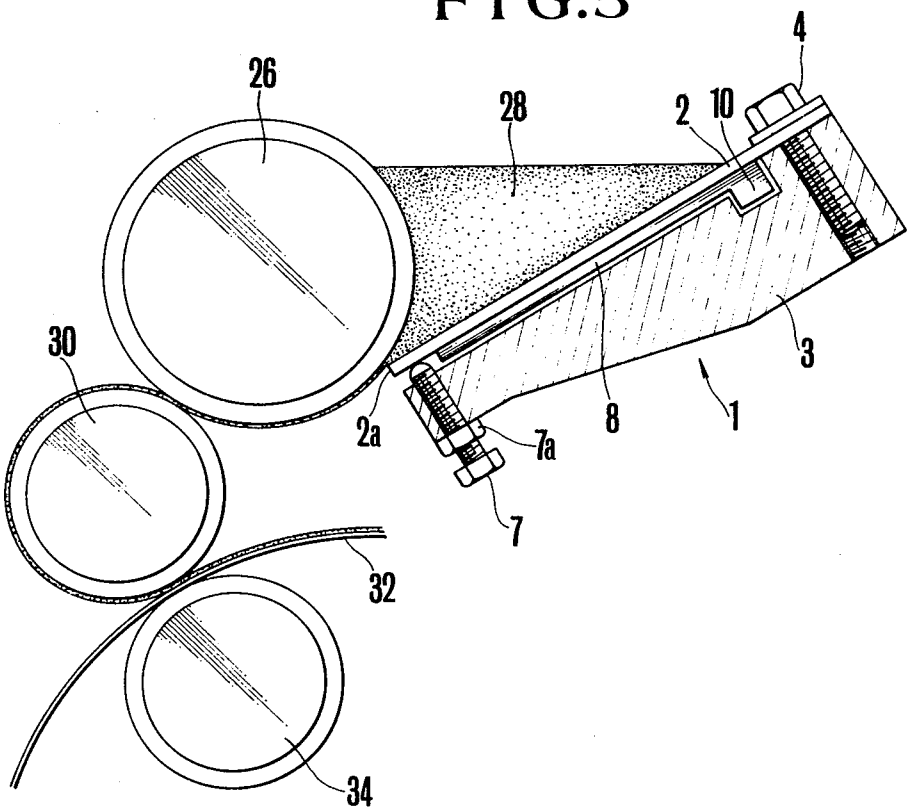
FIG. 5 is a schematic view showing the heat-controlled doctor knife according to the present invention, which is adapted for an applicator roll for coating printing ink on a sheet material.

Referring now to FIG. 5, which shows the heat-controlled doctor knife 1 adapted for operation for printing a sheet material, an ink pick-up roll 26 is passed through a supply 28 of printing ink, which is appropriately contained and positioned relative to the pick-up roll. The printing ink is transferred to the printing roll 30, which is in rolling contact with the ink pick-up roll 26, for printing a sheet material 32 fed between the printing roll and a pressing roll 34. The support member 3 properly positions the doctor knife 1 relative to the pick-up roll 26, such that the working edge 2*a* of the blade 2 is disposed parallel to the longitudinal surface of the roll. The spacing between the surface of the pick-up roll 26 and the working edge 2*a*, which controls the thickness of the ink on the surface of the roll, may be selectively adjusted by loosening the lock means 7*a*, moving the blade flexing member 7 upwardly or downwardly relative to the support member 3, and resetting the lock means.

An an example, the flat, flexible, heat-generating element 8 may have a heating area of 60 mm × 650 mm (perpendicular to and parallel to the axis of the pick-up roll 26, respectively), a resistance of 750 ohms and a current rating of 0.3 A, and may be covered with a thin, stainless steel sheet to provide a waterproof and antiexplosive construction. In the embodiment of FIG. 3 the heat-generating element 8 maintains the doctor knife 1 at 30° C. when the pick-up roll 26 is operated at a room temperature of 18° C. during the winter season to permit the smooth and uniform application of the printing ink onto the sheet material 32. The ink supply 15 is maintained at a constant temperature of approximately 20° C.–30° C. during printing operations in the winter season. The amount of ink picked up by the roll 26 is controlled constantly to produce prints of optimum quality throughout the operating hours, regardless of the ambient temperature.

It will be appreciated from the foregoing description that the heat-controlled doctor knife of the present invention is very useful in correctly and constantly controlling the amount of a printing ink to be applied on a sheet material, as well as to other situations in which it is desired to provide a uniform coating on a sheet material, without concern for the effect of ambient temperatures.

Although not particularly illustrated in the drawings, it is understood that all of the components described above are arranged and supported in an appropriate fashion to form a complete and operative system. Further it is understood that all ancillary components, such as motors, pumps, material transfer systems, etc., have not been specifically described, but such components are known in the art and would be appropriately incorporated into the operative system.

Of course, variations of the specific construction and arrangement of the pollution control system disclosed above can be made by those skilled in the art without departing from the invention as defined in the appended claims.

What is claimed is:

1. A heat-controlled doctor knife comprising:

a thin, flexible blade, fixedly supported along one edge on a support member;

blade flexing means disposed adjacent to and adapted to adjust the angle of the working edge of said blade opposite the fixed edge;

a flat, flexible, heat-generating element securely mounted on and in contact with one side of said blade and extending adjacent to said blade flexing means, said heat-generating element being capable of uniform heat distribution and in the form of a laminate of a sheet of carbon fiber-containing paper heat element, an electrical conductor connected to said heating element, first layers of a synthetic resin laminated to both surfaces of said heating element, layers of aluminum foil laminated to both outer surfaces of said first synthetic resin layers, and second layers of synthetic resin laminated to both outer surfaces of said aluminum foils; and temperature control means, including a heat-sensitive fuse and a thermostat, coupled to said heat-generating element to regulate the temperature of said blade.

2. The heat-controlled doctor knife of claim 1, wherein said blade flexing means comprises:

a plurality of members adjustably supported on said support member; and a lock means cooperating with each of said plurality of members to maintain a predetermined position of said members, said members being vertically adjustable relative to the blade-supporting surface of said support member and adapted to engage said blade to change the angle of said working edge relative to the fixed edge of said blade.

3. The heat-controlled doctor knife of claim 1, wherein said heat-generating element is disposed on the side of said blade adjacent to said support member.

* * * * *